US009721548B1

(12) United States Patent
Krause

(10) Patent No.: US 9,721,548 B1
(45) Date of Patent: Aug. 1, 2017

(54) BASS DRUM BEATER APPARATUS, BASS DRUM PEDAL SYSTEM, AND METHODS OF MAKING AND USING THE SAME

(71) Applicant: Aaron Krause, Wonder Lake, IL (US)

(72) Inventor: Aaron Krause, Wonder Lake, IL (US)

( * ) Notice: Subject to any disclaimer, the term of this patent is extended or adjusted under 35 U.S.C. 154(b) by 0 days.

(21) Appl. No.: 15/379,614

(22) Filed: Dec. 15, 2016

(51) Int. Cl.
*G10D 13/02* (2006.01)
*G10D 13/00* (2006.01)

(52) U.S. Cl.
CPC ..... *G10D 13/006* (2013.01)

(58) Field of Classification Search
CPC ..... G10D 13/006
See application file for complete search history.

(56) References Cited

U.S. PATENT DOCUMENTS 3,316,792 A * 5/1967 Ippolito ..... G10D 13/006 84/422.1

* cited by examiner

*Primary Examiner* — Robert W Horn
(74) *Attorney, Agent, or Firm* — Scherrer Patent & Trademark Law, P.C.; Stephen T. Scherrer; Monique A. Morneault

(57) ABSTRACT

The present invention relates to a bass drum beater apparatus. Specifically, the bass drum beater apparatus comprises a beater head interconnected with a spring element that is, in turn, interconnected to a base element that is connected to a beater rod. A bass drum pedal system is further provided. Methods of making and using the same are further provided.

20 Claims, 4 Drawing Sheets

—PRIOR ART—

BASS DRUM BEATER APPARATUS, BASS DRUM PEDAL SYSTEM, AND METHODS OF MAKING AND USING THE SAME

TECHNICAL FIELD

The present invention relates to a bass drum beater apparatus. Specifically, the bass drum beater apparatus comprises a beater head interconnected with a spring element that is, in turn, interconnected to a base element that is connected to a beater rod. A bass drum pedal system is further provided. Methods of making and using the same are further provided.

BACKGROUND

The bass drum, also commonly known as a kick drum when associated with drum kits, typically comprises a kick pedal. In 1900, Sonor drum company introduced the first single bass drum pedal, but was difficult to use. William F. Ludwig made the bass drum pedal workable in 1909, paving the way for the modern drum kit. To utilize the kick pedal, a footplate is pressed to pull a chain, belt, or metal drive mechanism downward, bringing a beater or mallet forward into the drumhead.

FIG. 1 illustrates a standard prior art foot pedal including a drum beater. A foot pedal 1 is attached to a strap or chain 2 that is engaged to a beater holder 3 on a rotating axle 4. Extending from the beater holder 3 is a rod or shaft 5 having a beater head 6 thereon. Upon pressing the foot pedal 1, thereby pulling the strap or chain 2, the beater holder 3, and thus the rod or shaft 5 and beater head 6, rotate about the axle 4, and the beater head 6 moves to strike a drum head surface to produce the bass drum sound. A spring assembly 7 may return the beater holder 3 into a "reset" position until the pedal is once again depressed. It should be noted that a prior art foot pedal may also be a "direct drive" system, without a strap or chain allowing direct movement of the beater when depressing the pedal without a strap or chain.

The beater head is usually made of felt, wood, plastic, or rubber and is attached to the rod or shaft. The pedal and beater system are mounted in a metal frame and a tension unit controls the amount of pressure needed to strike and the amount of recoil upon release. A spring assembly can be utilized to reset the kick pedal and move the beater or mallet away from the drum head surface after striking the drum head surface.

As noted above, the beater head can be made of felt, wood, plastic or rubber. The particular material utilized can affect the sound produced by the drum upon striking the same. For example, a softer surface made of felt or rubber can produce a relatively muffled sound, while a harder surface, such as made from wood or plastic, can produce a sharper sound. Indeed, different beater heads may be utilized depending on the type of sound desired by the user.

However, even with the use of different materials, it is oftentimes difficult to control the sound desired and the recoil of the beater head off the drum head surface. A need, therefore, exists for a beater apparatus providing a desired sound. Moreover, a need exists for a beater apparatus allowing for desired recoil, which may further influence the sound qualities of the bass drum.

In addition, typical drum beater heads may absorb or transfer energy in undesirable ways when the drum beater heads strike the drum head surface. A need exists for control of the drum beater head for proper energy transfer between the drum beater head and the drum head surface. Specifically, a need exists for control of the drum beater head for proper energy transfer between the drum beater head and the drum head surface for the desired sound qualities and recoil thereof.

Oftentimes, drum beater heads are a complicated combination of materials, including the aforementioned felt, wood, plastic and rubber in order to obtain the desired sound and recoil qualities. A need exists for a drum beater apparatus comprises relatively simple materials. Specifically, a need exists for a drum beater apparatus having desired sound and recoil qualities utilizing materials such as metal and composite plastic.

SUMMARY OF THE INVENTION

The present invention relates to a bass drum beater apparatus. Specifically, the bass drum beater apparatus comprises a beater head interconnected with a spring element that is, in turn, interconnected to a base element that is connected to a beater rod. A bass drum pedal system is further provided. Methods of making and using the same are further provided.

To this end, in an embodiment of the present invention, a drum beater apparatus is provided. The drum beater apparatus comprises: a base element engaged with a rod, the rod configured to be engaged to a drum pedal; a spring portion extending from the base element; and a contact element engaged to the spring portion, the contact element comprising a front contact surface configured to strike a drum head surface.

In an embodiment, the base element and the spring portion are constructed from a unitary piece.

In an embodiment, the base element and the spring portion are separate pieces that are engaged together.

In an embodiment, the drum beater apparatus further comprises: a groove in the contact element, wherein an end of the spring portion is disposed within the groove in the contact element.

In an embodiment, the drum beater apparatus further comprises: a groove in the base element, wherein an end of the spring portion is disposed within the groove in the base element.

In an embodiment, the drum beater apparatus further comprising: a first groove in the base element, wherein a first end of the spring portion is disposed within the first groove in the base element; and a second groove in the contact element, wherein a second end of the spring portion is disposed within the second groove in the contact element.

In an embodiment, the drum beater apparatus further comprises: a tab extending from the base element, the tab disposed within an end of the spring portion.

In an embodiment, the drum beater apparatus further comprises: a tab extending from the contact element, the tab disposed within an end of the spring portion.

In an embodiment, the drum beater apparatus further comprising: a first tab extending from the base element, the first tab disposed within a first end of the spring portion; and a second tab extending from the contact element, the second tab disposed within a second end of the spring portion.

In an embodiment, the drum beater apparatus further comprises: a bore in the base element, wherein the rod is disposed within the bore of the base element.

In an embodiment, the front contact surface of the contact element is flat.

In an embodiment, the front contact surface of the contact element is rounded.

In an embodiment, the contact element is made from a material selected from the group consisting of plastic, wood, metal, rubber and combinations thereof.

In an alternate embodiment of the present invention, a pedal drum system is provided. The pedal drum system comprises: a foot pedal; a beater holder disposed on an axle; a strap or chain extending from the foot pedal to the beater holder, wherein pressing the foot pedal causes the strap or chain to rotate the beater holder on the axle; and a beater apparatus comprising a base element engaged with a rod, the rod extending from the beater holder, a spring portion extending from the base element, and a contact element engaged to the spring portion, the contact element comprising a front contact surface configured to strike a drum head surface.

In an embodiment, the pedal drum system further comprises: a bass drum, the bass drum positioned to be struck by the front contact surface of the contact element.

In an embodiment, the front contact surface of the contact element is flat.

In an embodiment, the front contact surface of the contact element is rounded.

In an embodiment, the spring portion extends from the base element and engages with contact element.

In an embodiment, the contact element comprises a first groove and a first end of the spring portion is disposed within the first groove of the contact element.

In an embodiment, the base element comprises a second groove and a second end of the spring portion is disposed within the second groove of the base element.

It is, therefore, an advantage and objective of the present invention to provide a beater apparatus providing a desired sound.

Moreover, it is an advantage and objective of the present invention to provide a beater apparatus allowing for desired recoil, which may influence the sound qualities of the bass drum.

In addition, it is an advantage and objective of the present invention to provide for control of the drum beater head for proper energy transfer between the drum beater head and the drum head surface.

Specifically, it is an advantage and objective of the present invention to provide for control of the drum beater head for proper energy transfer between the drum beater head and the drum head surface for the desired sound qualities and recoil thereof.

Further, it is an advantage and objective of the present invention to provide a drum beater apparatus comprises relatively simple materials.

Still further, it is an advantage and objective of the present invention to provide a drum beater apparatus having desired sound and recoil qualities utilizing materials such as metal and composite plastic.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to a bass drum beater apparatus. Specifically, the bass drum beater apparatus comprises a beater head interconnected with a spring element that is, in turn, interconnected to a base element that is connected to a beater rod. A bass drum pedal system is further provided. Methods of making and using the same are further provided.

Figure 1:
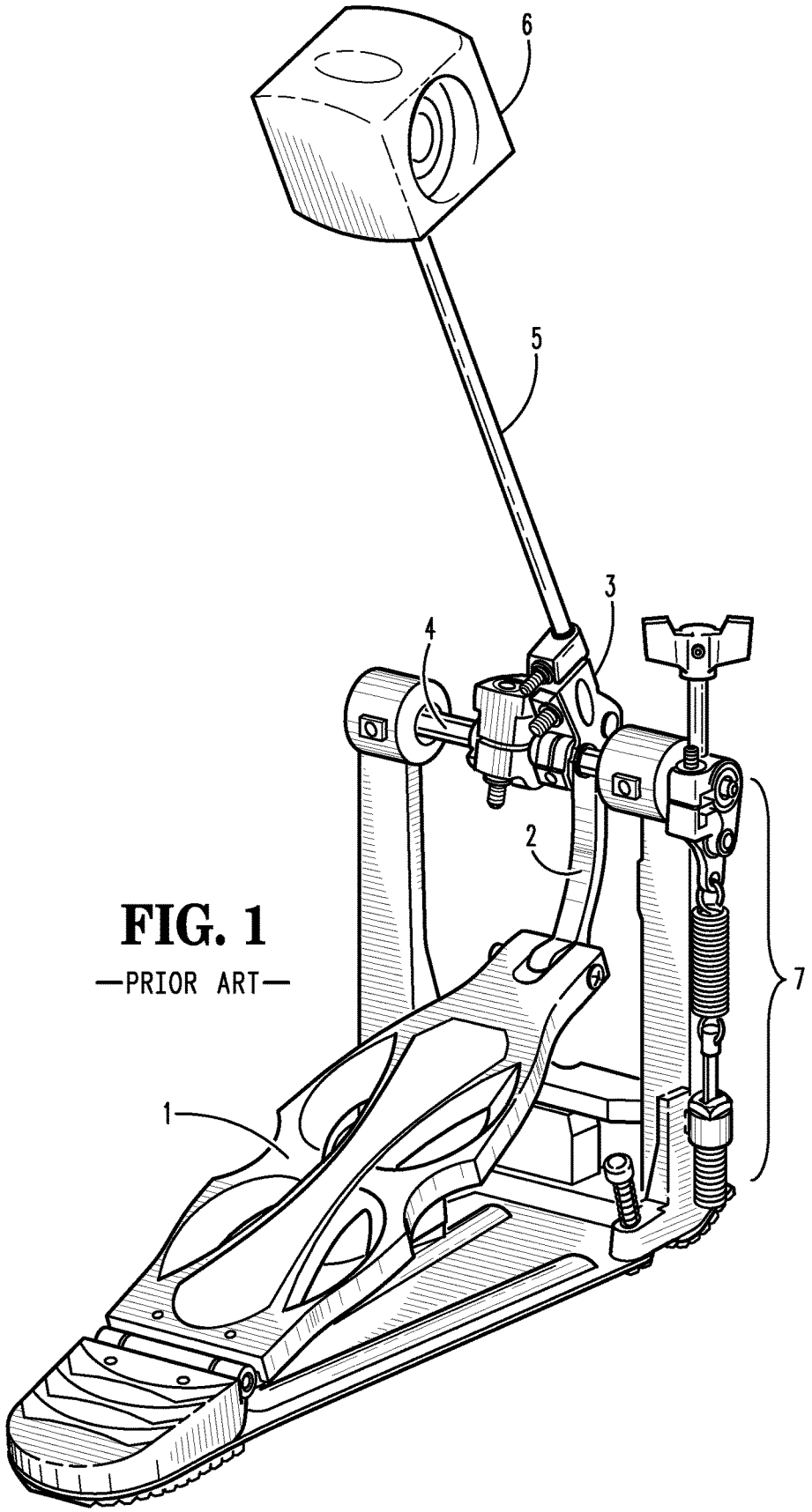
FIG. 1 illustrates a prior art bass drum pedal, including a beater head.
Figure 2:
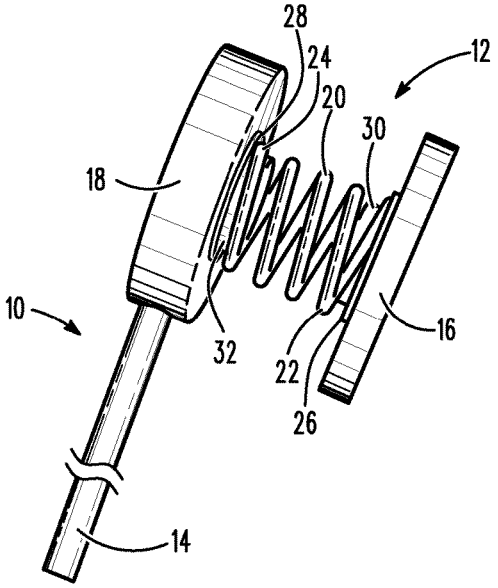
FIG. 2 illustrates a drum beater head and rod in an embodiment of the present invention.

Now referring to the figures, wherein like numerals refer to like parts, FIG. 2 illustrates a beater apparatus 10 in an embodiment of the present invention. The beater apparatus 10 comprises a beater head 12 that is adjoined to a rod or shaft 14. Specifically, the beater head 12 may have a bore into which the rod or shaft 14 is disposed and held. The beater head 12 may have several components that provide a user with a distinctive sound when the beater head engages with a drum head surface (not shown), and further provides a distinctive recoil action. These features are attributable to the following elements.

Specifically, the beater head 12 may comprise a drum head surface contact element 16 that is separated from a base element 18 via a spring 20. The spring may have ends 22, 24 that may be interconnected to the contact element 16 and the base element 18, respectively. In a non-limiting example, the spring end 22 may be disposed within a groove 26 within the contact element 16 while the spring end 24 may be disposed within a groove 28 within the base element 18. Moreover, the contact element 16 may have a tab 30 extending therefrom and disposed within the spring end 22, and the base element 18 may have a tab 32 extending therefrom and disposed within the spring end 24. The tabs 30, 32 may maintain the spring 20 in position on both the contact element 16 and the base element 18.

The contact element 16 and the base element 18 may preferably be made of a composite thermoplastic material, although it should be noted that the contact element 16 and the base element 18 may be made from any material, including metal, rubber, wood, or other like materials. Preferably, the spring 20 may be disposed within the grooves 26, 28 of the contact element 16 and the base element 18, respectively, which may preferably be made from composite thermoplastic. Heat may be applied to the contact element 16 and the base element 18 to melt or partially melt the composite plastic material and adhere the same to the spring 20, thereby rigidly holding the spring 20 within the grooves 26, 28.

Figure 3:
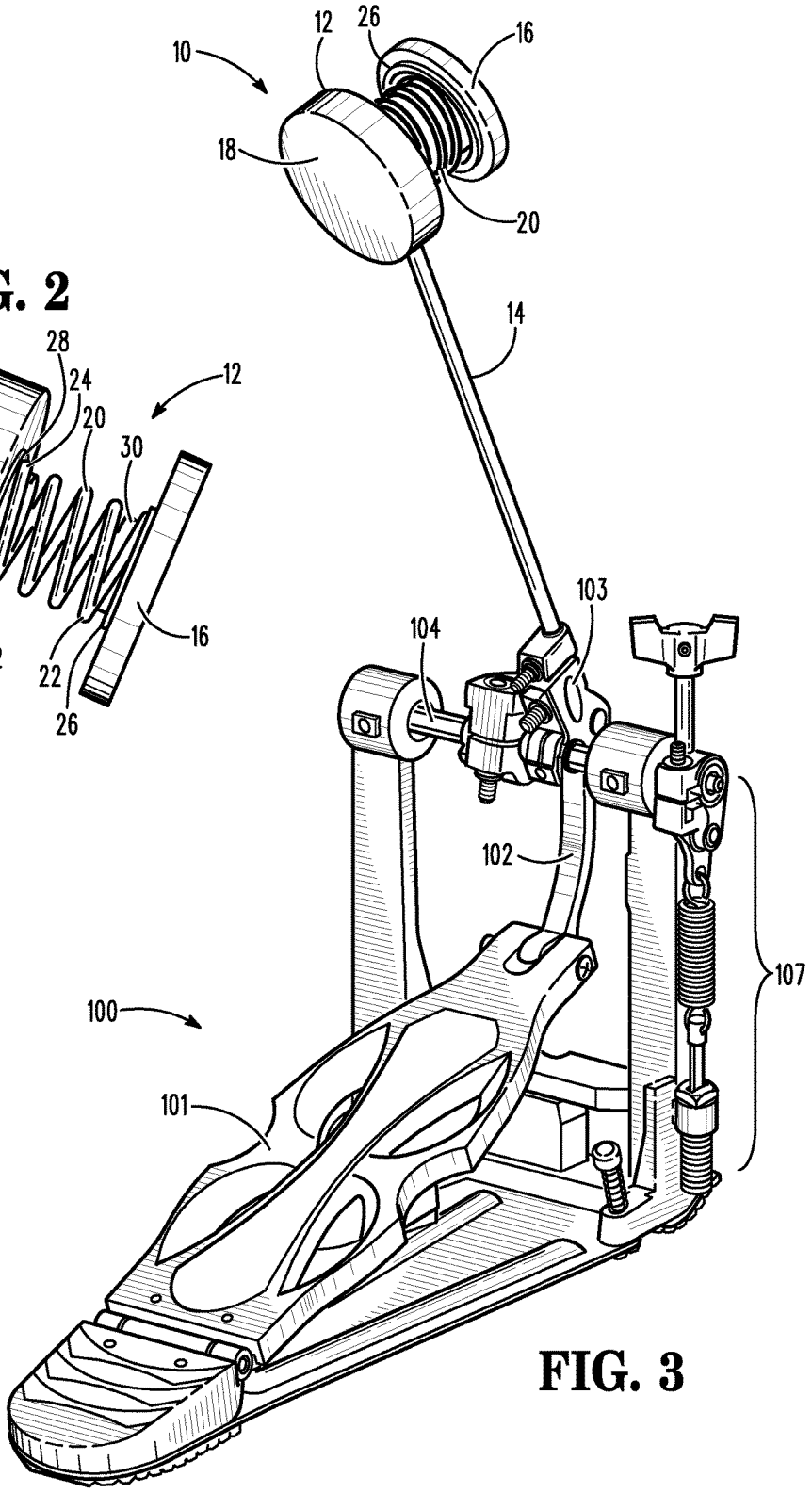
FIG. 3 illustrates a bass drum pedal including a beater head and rod in an embodiment of the present invention.

Now referring to FIG. 3, a bass drum pedal system 100 is illustrated showing the beater apparatus 10, as described above. The bass drum pedal system 100 may have a pedal 101, a strap or chain 102 for rotating a beater holder 103 on an axle 104. Spring assembly 107 may move the beater apparatus 10 back into a reset position after a user has depressed the pedal and the beater apparatus 10 has struck a drum head surface. The rod or shaft 14 of the beater apparatus 10 of the present invention may extend from the beater holder 103, and the beater head 12 may be positioned to engage a drum head surface (not shown) when the pedal 101 is pressed by a user. It should be noted that the bass drum pedal system 100 may also be a direct drive system, without a strap or chain, wherein depressing the pedal causes the drum beater to move directly, and the present invention should not be limited as described herein.

The spring 20 may have a spring constant that provides the desired sound and recoil. Specifically, the spring 20 may be relatively "loose" and springy, allowing the contact element 16 to maintain longer contact with the drum head surface due to large compression of the spring. Alternatively, the spring 22 may be relatively "tight", causing the contact element 16 to "jump" off the drum head surface rapidly. Thus, the relative "looseness" or "tightness" of the spring 20 may affect the sound and recoil of the bass drum when struck by the beater apparatus 10.

Besides the relative looseness or tightness of the spring, various other elements may affect the sound and recoil of the beater apparatus 10 when utilized to contact a drum head surface. Specifically, the contact element 16 may be made from different materials, such as relatively harder materials (such as metal, for example) or softer materials (such as rubber, for example). Moreover, the rod or shaft 14 may have a weight disposed thereon that may be slid and clamped to the rod or shaft 14, which may impact how the beater interacts with the drum head surface, as apparent to one of ordinary skill in the art.

Figure 4:
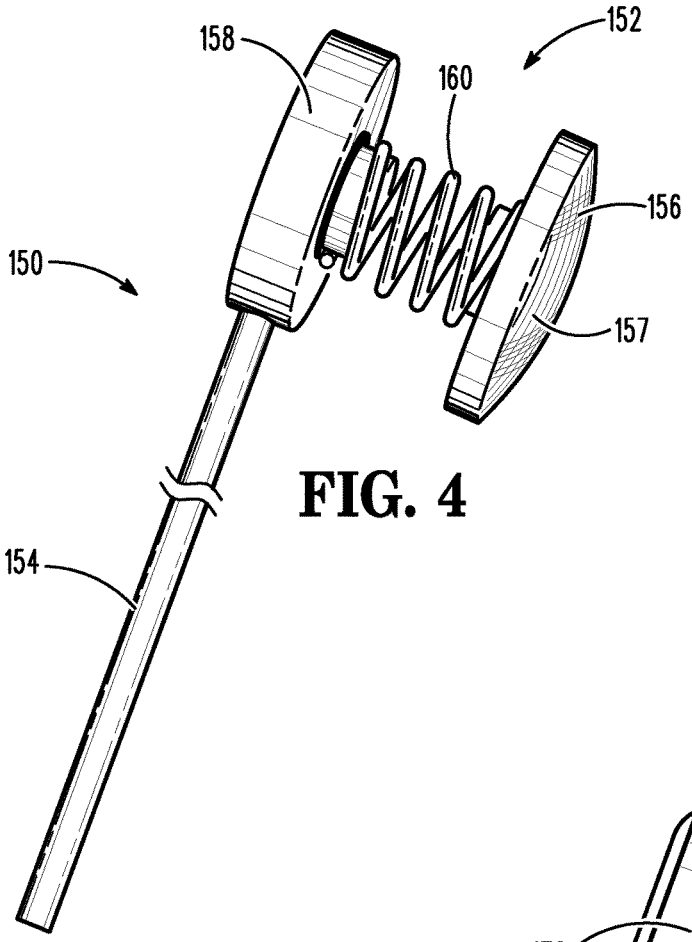
FIG. 4 illustrates a drum beater head in an alternate embodiment of the present invention.

As illustrated in FIG. 4, a beater apparatus 150 is illustrated in an alternate embodiment of the present invention. The beater apparatus 150 may comprise a beater head 152 and a rod or shaft 154 in the same manner as provided above with respect to the apparatus 10. The beater head 152 may comprise a spring 160, a base element 158 and a contact element 156. However, the contact element 156 may have a rounded surface 157 instead of the flat surface shown in FIG. 2. The rounded surface 157 may allow the contact element 156 to engage the drum head surface (not shown) from any angle or position, and a user may not be required to adjust the apparatus on the pedal system to optimally engage the drum head surface as the user would need to do if the contact surface was flat.

Figure 5:
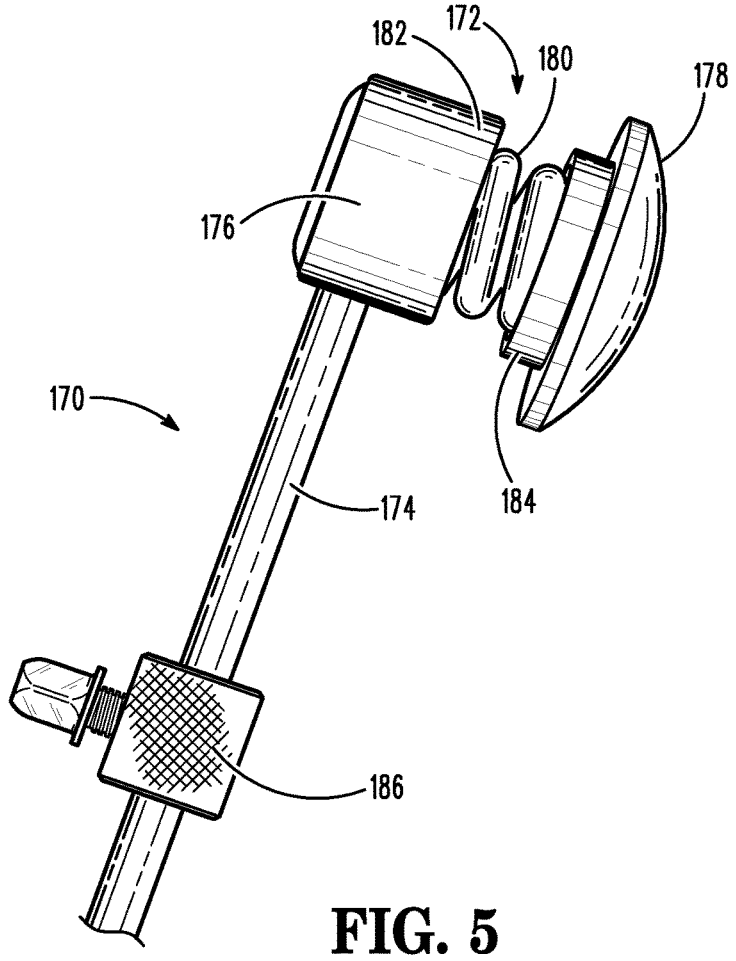
FIG. 5 illustrates yet another drum beater head in an alternate embodiment of the present invention.

FIG. 5 illustrates beater apparatus 170 in an alternate embodiment of the present invention. The beater apparatus 170 comprises a beater head 172 and a rod or shaft 174 in the same manner as provided above with respect to beater apparatus 150. As with beater apparatus 150, the beater head 172 may comprise a spring 180, a base element 178 and a contact element 176. The contact element 176 may have a rounded surface, much like the contact element 156 described above and shown in FIG. 4. The spring 180 may be disposed within deep grooves (not shown) within both the base element 178 and the contact element 176, such that the outer portion of the grooves 182, 184 of the base element 178 and the contact element 176, respectively, may act as a sheath holding the spring 180 in place around the ends of the spring 180.

The rod or shaft 174 may further have a weight 186 that may be disposed thereon that may be slid up or down the rod or shaft 174 to change the manner in which the beater head 172 contacts the drum head surface.

Figure 6:
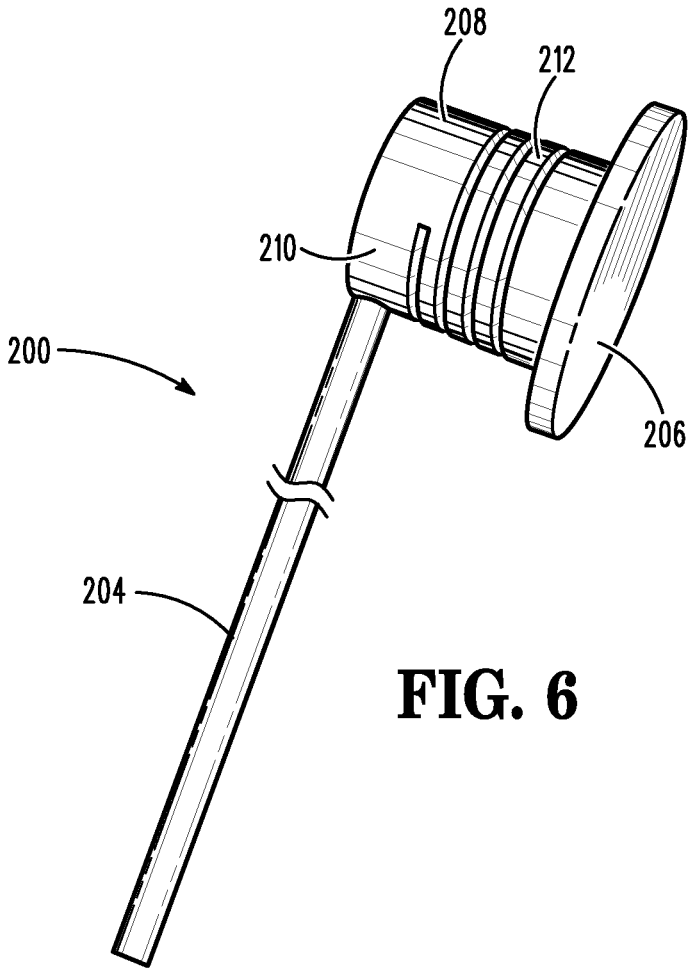
FIG. 6 illustrates a drum beater head in still yet another alternate embodiment of the present invention.

In an alternate embodiment of the present invention, illustrated in FIG. 6, a beater apparatus 200 is illustrated. The beater apparatus 200 may have a beater head 202 and a rod or shaft 204. The beater head 202 may have a contact element 206. However, instead of having a separate base element and spring, there may be a base and spring combination element 208 that is constructed as a unitary piece, which may be made from any rigid material, such as metal or composite plastic or the like. The base and spring combination element 208 may have a base portion 210 having a bore for engaging the rod or shaft 204 and a spring portion 212 that may extend from the base portion 210, but made from the same material as the base portion. The spring portion 212 may extend until it engages with the contact element 206.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are non-limiting, and it should be noted that claim limitations presented herein are not meant to describe the invention as a whole. Moreover, the invention illustratively disclosed herein suitably may be practiced in the absence of any element which is not specifically disclosed herein.

I claim:

1. A drum beater apparatus comprising:

a base element engaged with a rod, the rod configured to be engaged to a drum pedal;

a spring portion extending from the base element; and a contact element engaged to the spring portion, the contact element comprising a front contact surface configured to strike a drum head surface.

2. The drum beater apparatus of claim 1 wherein the base element and the spring portion are constructed from a unitary piece.

3. The drum beater apparatus of claim 1 wherein the base element and the spring portion are separate pieces that are engaged together.

4. The drum beater apparatus of claim 1 further comprising:

a groove in the contact element, wherein an end of the spring portion is disposed within the groove in the contact element.

5. The drum beater apparatus of claim 1 further comprising:

a groove in the base element, wherein an end of the spring portion is disposed within the groove in the base element.

6. The drum beater apparatus of claim 1 further comprising:

a first groove in the base element, wherein a first end of the spring portion is disposed within the first groove in the base element; and a second groove in the contact element, wherein a second end of the spring portion is disposed within the second groove in the contact element.

7. The drum beater apparatus of claim 1 further comprising:

a tab extending from the base element, the tab disposed within an end of the spring portion.

8. The drum beater apparatus of claim 1 further comprising:

a tab extending from the contact element, the tab disposed within an end of the spring portion.

9. The drum beater apparatus of claim 1 further comprising:

a first tab extending from the base element, the first tab disposed within a first end of the spring portion; and a second tab extending from the contact element, the second tab disposed within a second end of the spring portion.

10. The drum beater apparatus of claim 1 further comprising:

a bore in the base element, wherein the rod is disposed within the bore of the base element.

11. The drum beater apparatus of claim 1 wherein the front contact surface of the contact element is flat.

12. The drum beater apparatus of claim 1 wherein the front contact surface of the contact element is rounded.

13. The drum beater apparatus of claim 1 wherein the contact element is made from a material selected from the group consisting of plastic, wood, metal, rubber and combinations thereof.

14. A pedal drum system comprising:

a foot pedal;

a beater holder disposed on an axle;

a strap or chain extending from the foot pedal to the beater holder, wherein pressing the foot pedal causes the strap or chain to rotate the beater holder on the axle; and a beater apparatus comprising a base element engaged with a rod, the rod extending from the beater holder, a spring portion extending from the base element, and a contact element engaged to the spring portion, the contact element comprising a front contact surface configured to strike a drum head surface.

15. The pedal drum system of claim 14 further comprising:

a bass drum, the bass drum positioned to be struck by the front contact surface of the contact element.

16. The pedal drum system of claim 14 wherein the front contact surface of the contact element is flat.

17. The pedal drum system of claim 14 wherein the front contact surface of the contact element is rounded.

18. The pedal drum system of claim 14 wherein the spring portion extends from the base element and engages with contact element.

19. The pedal drum system of claim 18 wherein the contact element comprises a first groove and a first end of the spring portion is disposed within the first groove of the contact element.

20. The pedal drum system of claim 19 wherein the base element comprises a second groove and a second end of the spring portion is disposed within the second groove of the base element.

* * * * *